US010262576B2

(12) United States Patent
Lin

(10) Patent No.: US 10,262,576 B2
(45) Date of Patent: Apr. 16, 2019

(54) DISPLAY DEVICE, CONTROL CIRCUIT AND ASSOCIATED CONTROL METHOD

(71) Applicant: NOVATEK MICROELECTRONICS CORP., HsinChu (TW)

(72) Inventor: Li-Tang Lin, Hsinchu (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 135 days.

(21) Appl. No.: 15/456,714

(22) Filed: Mar. 13, 2017

(65) Prior Publication Data

US 2018/0261144 A1 Sep. 13, 2018

(51) Int. Cl.
*G09G 3/20* (2006.01)

(52) U.S. Cl.
CPC ... *G09G 3/2092* (2013.01); *G09G 2310/0213* (2013.01); *G09G 2310/08* (2013.01); *G09G 2320/041* (2013.01); *G09G 2320/062* (2013.01); *G09G 2330/045* (2013.01); *G09G 2340/16* (2013.01)

(58) Field of Classification Search
CPC ..... G09G 2310/0213; G09G 2310/08; G09G 2320/041; G09G 2320/062; G09G 2330/045; G09G 2340/16; G09G 3/2092
USPC ..... 345/690
See application file for complete search history.

(56) References Cited

U.S. PATENT DOCUMENTS 9,837,053 B1 * 12/2017 Cheng ..... G09G 5/393
2009/0322969 A1 * 12/2009 Unger ..... G09G 5/003 348/790
2014/0347404 A1 * 11/2014 Lee ..... G09G 5/18 345/690
2015/0264298 A1 * 9/2015 Colenbrander ..... H04N 7/013 345/547
2017/0064300 A1 * 3/2017 Yang ..... H04N 19/107
2017/0301301 A1 * 10/2017 Pan ..... G09G 3/3618

* cited by examiner

*Primary Examiner* — Tony O Davis
(74) *Attorney, Agent, or Firm* — McClure, Qualey & Rodack, LLP

(57) ABSTRACT

A display device, a control circuit and associated control method are provided. The display device includes the control circuit and a display panel. The control circuit receives a plurality of source frames with a source frame rate. The control circuit generates a plurality of data signals and a plurality of gate signals based on the plurality of source frames. The display panel is electrically connected to the control circuit. The display panel displays the plurality of output frames according to the plurality of data signals and the plurality of gate signal. The plurality of output frames are displayed with one of a first refresh frame rate and a second refresh frame rate. The source frame rate is equivalent to the first refresh frame rate, and the source frame rate is greater than the second refresh frame rate.

18 Claims, 14 Drawing Sheets

DISPLAY DEVICE, CONTROL CIRCUIT AND ASSOCIATED CONTROL METHOD

TECHNICAL FIELD

The disclosure relates in general to a display device, a control circuit and associated control method and more particularly to a display device, a control circuit and associated control method capable of dynamically adjusting a refresh frame rate.

BACKGROUND

FIG. 1A is a schematic diagram illustrating a conventional display device. The display device 10 includes a control circuit 12 and a display panel 19, and the control circuit 12 includes a timing controller 13, a source module 15 and a gate module 17.

The timing controller 13 receives input video data from an image or graphic processing circuit, which changes the input video data to be compatible with the display panel 19. The input video data are stored in a frame buffer 131, and capacity of the frame buffer 131 may vary. The timing controller 13 controls operation and timing of the source module 15 through a data timing signal Sdt and data driving signals Srgb including RGB input information, and the timing controller 13 controls operation and timing of the gate module 17 through a gate timing signal Sgt.

The display panel 19 includes M data lines D(1)~D(M) and N gate lines G(1)~G(N) crossing each other and M×N pixel elements P(1,1)~P(M,N). Pixel elements P(1,1)~P(M, N) are arranged at intersections of data lines D(1)~D(M) and gate lines G(1)~G(N) to form an M×N pixel element array. It is noted that M and N are positive number, and the number of pixel elements and the arrangement of which are not restricted.

The source module 15 further includes a data driving circuit 151 and M source drivers SD(1)~SD(M). The data driving circuit 151 is electrically connected to the timing controller 13 and source drivers SD(1)~SD(M). The timing controller 13 aligns the RGB information in the input video signal in accordance with the display panel 19 and supplies the RGB information to the data driving circuit 15 through data driving signals Srgb. After receiving data driving signals Srgb and the data timing signal Sdt, the data driving circuit 151 generates data control signals Sdc and transmits the data control signals Sdc to source drivers SD(1)~SD(M).

Source drivers SD(1)~SD(M) are respectively electrically connected to pixel elements arranged at M columns through their corresponding data lines D(1)~D(M). After receiving the data control signals Sdc from the data driving circuit 151, the source drivers SD(1)~SD(M) transmit analog data voltages to pixel elements P(1,1)~P(M,N), as data signals, through the data lines D(1)~D(M). For example, source driver SD(1) is electrically connected to pixels elements P(1,1)~P(1,N) arranged at the first column through data line D(1). Accordingly, the analog data voltage being generated by source driver SD(1) is transmitted to pixel elements P(1,1)~P(1,N).

The gate module 17 further includes N gate drivers GD(1)~GD(N) to respectively generate gate signals being transmitted through gate lines G(1)~G(N). Gate drivers GD(1)~GD(N) are respectively electrically connected to pixel elements at the same horizontal pixel line through their corresponding gate lines G(1)~G(N). For example, gate driver GD(1) is electrically connected to pixels elements P(1,1)~P(M,1) arranged at the first horizontal pixel line through gate line G(1).

Internal circuits of pixel elements P(1,1)~P(M,N) are similar. At the lower right corner of FIG. 1, the dotted frame represents an internal circuit of pixel element P(M, N). Pixel element P(M,N) is arranged at the M-th column and the N-th horizontal pixel line. Pixel element P(M,N) includes a thin-film-transistor (hereinafter, TFT) $M_{MN}$ and a capacitor CA. Gate terminal of the TFT $M_{MN}$ is electrically connected to the N-th gate line G(N), source terminal of the TFT $M_{MN}$ is electrically connected to the M-th data line D(M), and the drain terminal of the TFT $M_{MN}$ is electrically connected to a terminal of the capacitor $C_{MN}$. The other terminal of the capacitor $C_{MN}$ is electrically connected to a ground terminal (Gnd).

FIG. 1B is a schematic diagram illustrating frame display sequence of the conventional display device. Frame rate, also known as frame frequency, is the frequency (rate) at which the display device 10 displays consecutive frames 18 in one second (1 sec). As shown in FIG. 1B, fFrame indicates the frame rate. Typically, 60 frames or 120 frames are displayed in one second, that is, fFrame=60 or fFrame=120.

FIG. 1C is a schematic waveform diagram illustrating signals related to the conventional display device. Signals related to two consecutive frames, frame(k) and frame(k+1) are illustrated as example.

For displaying frame(k), the control circuit 12 generates signals related to frame(k) and transmits these signals to the display panel 19 in a frame duration $T_{frame}$ between time point t1 and time point t5. For displaying frame(k+1), the control circuit 12 generates signals related to frame(k+1) and transmits these signals to the display panel 19. A frame duration $T_{frame}$ corresponding to frame(k+1) is between time point t5 and time point t9. The frame duration $T_{frame}$ is related to the frame rate "fFrame" of the display panel 19 as mentioned in FIG. 1B, that is, $T_{frame}$=1/fFrame.

Both the frame durations for displaying frame(k) and frame(k+1) are divided into N horizontal periods $T_{hr}$, and each horizontal period $T_{hr}$ is corresponding to a horizontal pixel line. Therefore, the horizontal period $T_{hr}$ can be defined as $T_{hr}=T_{frame}/N$. The horizontal period $T_{hr}$ is related to frame rate fFrame and resolution of the display device 10. The higher the frame rate fFrame of the display panel 19, the shorter the horizontal period $T_{hr}$ is. The higher the resolution of the display panel 19, the shorter the horizontal period $T_{hr}$ is. For the sake of illustration, the resolutions illustrated in the context focus on an active area (hereinafter, AA) within the display panel 19. Applications including non-AA are analogue and not redundantly illustrated.

When the display device 10 displays frames according to high definition (HD) standard, 1080 horizontal pixel lines of resolution is required to support 1920×1080 video format, and the frame duration $T_{frame}$ is divided into 1080 horizontal periods $T_{hr}$. When the display device 10 displays frames according to ultra-high-definition (UHD) standard, 2160 horizontal pixel lines of resolution is required to support 3840×2160 video format, and the frame duration $T_{frame}$ is divided into 2160 horizontal periods $T_h$.

Table 1 represents the horizontal period $T_{hr}$ based on different combination of the frame duration $T_{frame}$ and the resolution of the display device 10.

TABLE 1

| frame rate (fFrame) | resolution | horizontal period ($T_{hr}$) |
|---|---|---|
| 60 | 1920 × 1080 | 1/(60 × 1080) |
| | 3840 × 2160 | 1/(60 × 2160) |
| 120 | 1920 × 1080 | 1/(120 × 1080) |
| | 3840 × 2160 | 1/(120 × 2160) |

Please refer to FIGS. 1A and 1C together. The gate module 17 receives the gate timing signal Sgt from the timing controller 13, and shifts the gate timing signal Sgt to generate gate pulses. These gate pulses are used as gate signals, and the gate signals are transmitted to the display plane through gate lines G(1)~G(N).

Display of the k-th frame frame(k) is illustrated. Between time point t1 and time point t2, source drivers SD(1)~SD(M) jointly transmit analog data voltages to pixel elements P(1,1)~P(M,1) arranged at the first horizontal pixel line (h=1), and gate driver GD(1) transmits a gate pulse between time point t1 and time point t2. Between time point t2 and time point t3, source drivers SD(1)~SD(M) jointly transmit analog data voltages to pixel elements P(1,2)~P(M,2) arranged at the second horizontal pixel line (h=2), and gate driver GD(2) transmits another gate pulse. Similarly, between time point t4 and time point t5, source drivers SD(1)~SD(M) jointly transmit analog data voltages to pixel elements P(1,N)~P(M,N) arranged at the N-th horizontal pixel line (h=N), and gate driver GD(N) transmits still another gate pulse.

Pixel elements P(1,N)~P(M,N) in FIG. 1A are utilized to display pixel data between time point t4 and time point t5, and between time point t8 and time point t9. The operation of pixel element P(M,N) is illustrated below as an example.

During time point t4 and time point t5, the TFT $M_{MN}$ is tuned on because its gate terminal receives the high level of the N-th gate line G(N), and the M-th data line D(M) transmits the analog data voltage to the source terminal of the TFT $M_{MN}$. Therefore, the TFT $M_{MN}$ is turned on and the capacitor $C_{MN}$ is charged by the M-th data line D(M). Within the duration of displaying frame(k), the TFT $M_{MN}$ is turned on just between time point t4 and time point t5, and the TFT $M_{MN}$ is turned off between time point t1 and time point t4.

Similarly, during time point t8 and time point t9, the TFT $M_{MN}$ is turned on and the capacitor $C_{MN}$ is charged by the M-th data line D(M). Within the duration of displaying frame(k+1), the TFT $M_{MN}$ is turned on just between time point t8 and time point t9, and the TFT $M_{MN}$ is turned off between time point t5 and time point t8.

Based on the above illustrations, in N horizontal periods $T_{hr}$ of the frame duration $T_{frame}$, pixel elements P(1,N)~P(M,N) arranged at N horizontal pixel lines are alternatively controlled to display pixel data, and the capacitors of pixel elements P(1,N)~P(M,N) are alternatively charged.

With the increase of frame rate fFrame and resolution of the display device 10, the TFTs of pixel elements P(1,N)~P(M,N) are switched more often and the capacitors of pixel elements P(1,N)~P(M,N) are charged more often. In consequence, more power consumption is required to charge the capacitors of pixel elements P(1,N)~P(M,N). The increase of power consumption brings heat to source drivers SD(1)~SD(M), so that temperature of source drivers SD(1)~SD(M) tend to be high. However, high temperature of source drivers SD(1)~SD(N) may result in malfunction of the display device 10. Therefore, lowering temperature of source drivers SD(1)~SD(N) becomes an important issue.

SUMMARY

The disclosure is directed to a display device, a control circuit and associated control method for dynamically adjusting a refresh frame rate. With dynamic adjustment of the refresh frame rate, the temperature of a source module in the display device can be lowered while the output frames are continuously displayed.

According to one embodiment, a display device is provided. The display device includes a control circuit and a display panel. The control circuit receives a plurality of source frames with a source frame rate. The control circuit generates a plurality of data signals and a plurality of gate signals based on the plurality of source frames. The display panel is electrically connected to the control circuit. The display panel displays a plurality of output frames according to the plurality of data signals and the plurality of gate signal. The plurality of output frames are displayed with one of a first refresh frame rate and a second refresh frame rate. The source frame rate is equivalent to the first refresh frame rate, and the source frame rate is greater than the second refresh frame rate.

According to another embodiment, a control circuit electrically connected to a display panel is provided. The control circuit includes a timing controller, a source module, and a gate module. The timing controller receives a plurality of source frames with a source frame rate and accordingly generates a plurality of data driving signals, a data timing signal and a gate timing signal. The source module is electrically connected to the timing controller and the display panel. The source module, receives the plurality of data driving signals and the data timing signal and accordingly generating a plurality of data signals. The source module transmits the plurality of data signals to the display panel and transmits a trigger signal to the timing controller. The gate module is electrically connected to the timing controller and the display panel. The gate module receives the gate timing signal and accordingly transmits a plurality of gate signals to the display panel. The display panel displays a plurality of output frames according to the plurality of data signals and the plurality of gate signal. The plurality of output frames are displayed with one of a first refresh frame rate and a second refresh frame rate. The source frame rate is equivalent to the first refresh frame rate, and the source frame rate is greater than the second refresh frame rate.

According to still another embodiment, a control method applied to a display device is provided. The method includes following steps. Firstly, a plurality of source frames with a source frame rate is received. A plurality of data signals and a plurality of gate signals are generated based on the plurality of source frames. Then, a plurality of output frames are displayed according to the plurality of data signals and the plurality of gate signal. The plurality of output frames are displayed with one of a first refresh frame rate and a second refresh frame rate. The source frame rate is equivalent to the first refresh frame rate, and the source frame rate is greater than the second refresh frame rate.

Figure 1A:
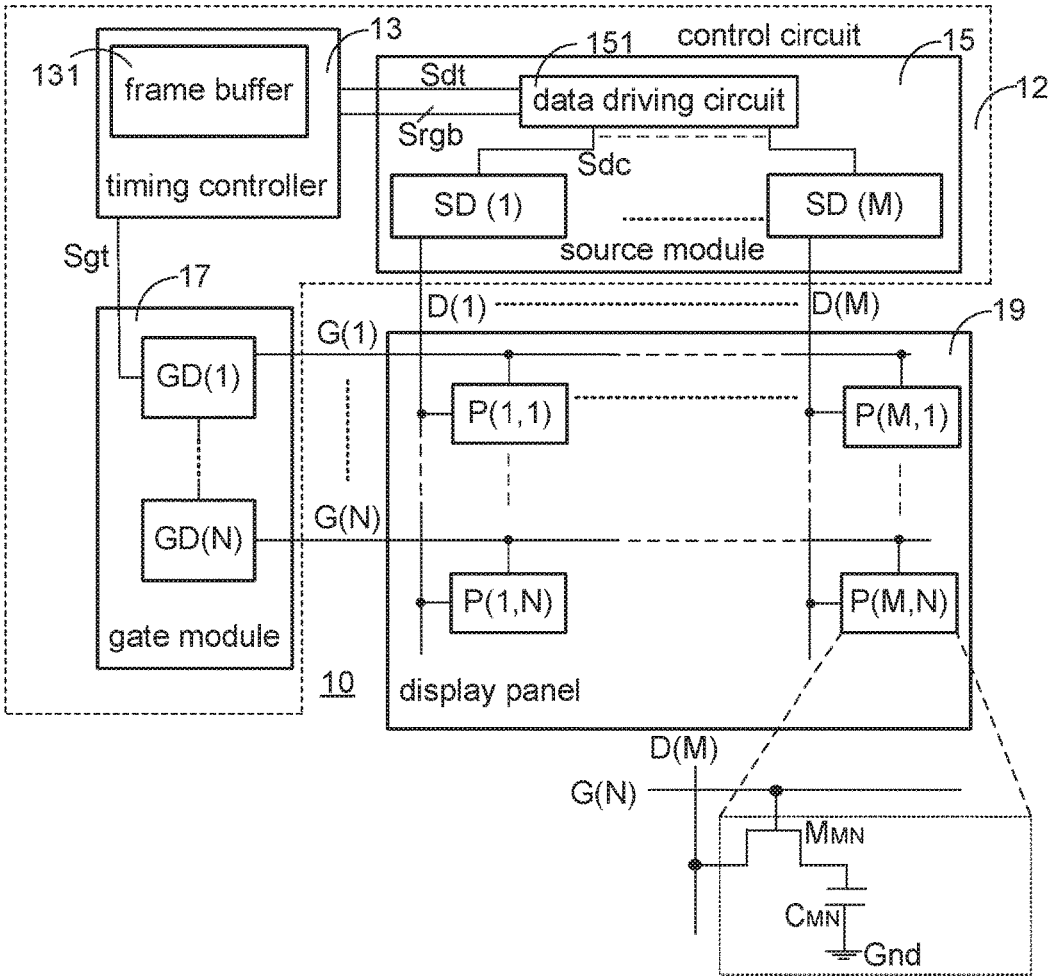
FIG. 1A (PRIOR ART)
FIG. 1A (prior art) is a schematic diagram illustrating a conventional display device.
Figure 1B:
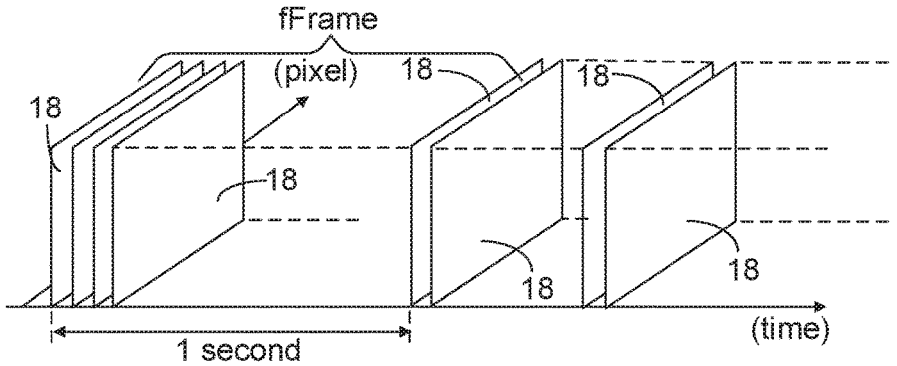
FIG. 1B (PRIOR ART)
FIG. 1B (prior art) is a schematic diagram illustrating frame display sequence of the conventional display device.
Figure 1C:
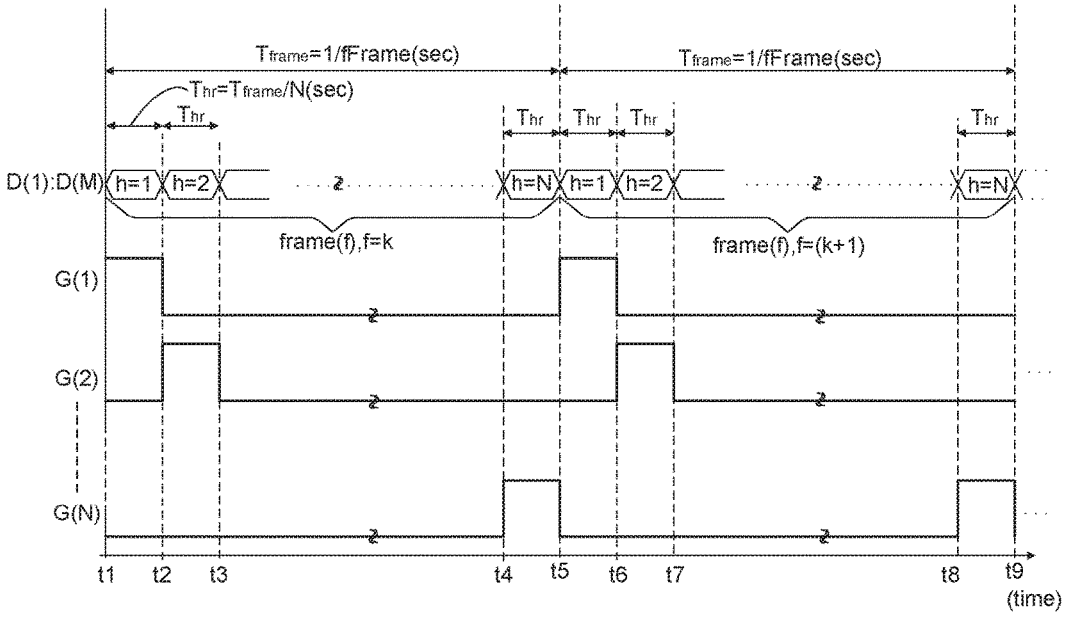
FIG. 1C (PRIOR ART)
FIG. 1C (prior art) is a schematic waveform diagram illustrating signals related to the display device in FIG. 1A.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Figure 2:
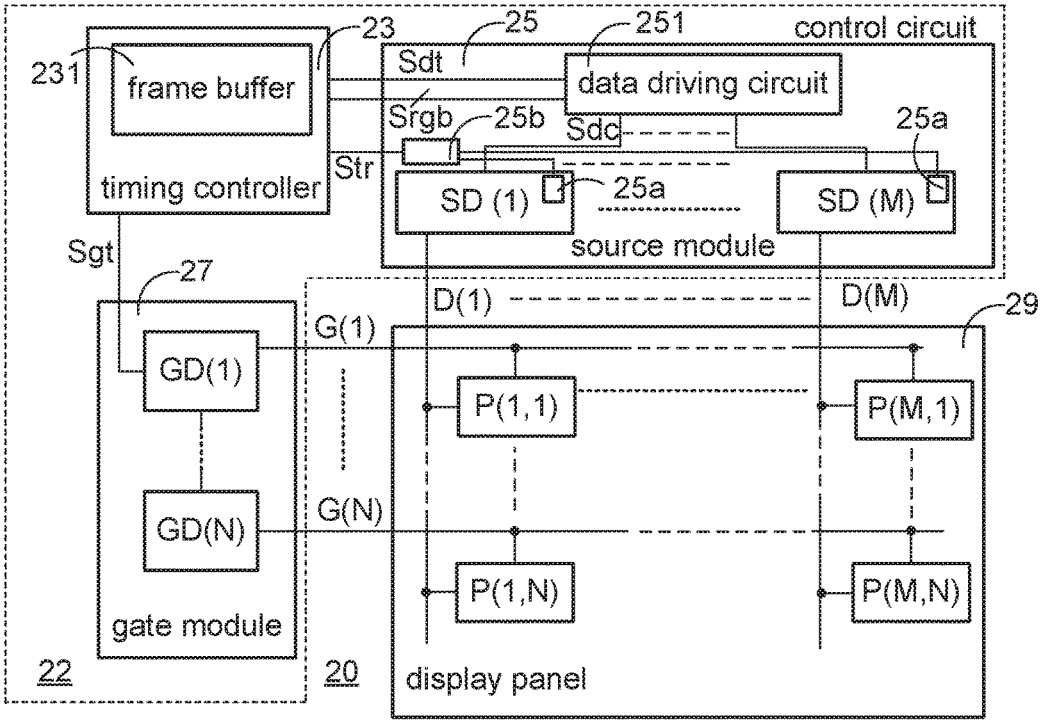
FIG. 2 is a schematic diagram illustrating a display device according to the present disclosure.

FIG. 2 is a schematic diagram illustrating a display device according to the present disclosure. The display device 20 includes a control circuit 22 and a display panel 29. The control circuit 22 includes a source module 25, a gate module 27, and a timing controller 23 including a frame buffer 231. Interconnections between these components are similar to the ones in FIG. 1A.

In addition to the source drivers SD(1)~SD(M), the source module 25 further includes a comparison circuit 25*b* and temperature detectors 25*a*. Each of the source drivers SD(1)~SD(M) is electrically connected with one of the temperature detectors 25*a*, and the temperature detectors 25*a* are electrically connected to the comparison circuit 25*b*. The comparison circuit 25*b* is electrically connected to the timing controller 23.

The temperature detectors 25*a* respectively detect temperature of source drivers SD(1)~SD(M), and transmit their detecting results to the comparison circuit 25*b*. The detecting results of the temperature detectors 25*a* are defined as detected temperatures TEMPdet(1)~TEMPdet(M), which are respectively corresponding to source drivers SD(1)~SD(M).

After receiving the detected temperatures TEMPdet(1)~TEMPdet(M), the comparison circuit 25*b* respectively compares these detected temperatures TEMPdet(1)~TEMPdet(M) with a temperature threshold TEMPthld. The temperature threshold TEMPthld can be predefined based on the temperature that the source drivers SD(1)~SD(M) can normally operate. For example, the temperature threshold TEMPthld can be 150 degrees Celsius.

Then, the comparison circuit 25*b* transmits a trigger signal Str to the timing controller 23. The level of the trigger signal Str is determined based on the detected temperatures TEMPdet(1)~TEMPdet(M). According to the embodiment of the present disclosure, the display device 20 can operate in a first operation mode (M1) (for example, normal mode) or a second operation mode (M2) (for example, low power mode). Depending on the detected temperatures, the display device 20 may or may not transit between its operation modes.

In a case that the display device 20 operates in the normal mode, the display device 20 changes to the low power mode if any of the detected temperatures TEMPdet(1)~TEMPdet(M) is greater than or equivalent to the temperature threshold TEMPthld, or the display device 20 continuously operates in the normal mode if all of the detected temperatures TEMPdet(1)~TEMPdet(M) are less than the temperature threshold TEMPthld.

In a case that the display device 20 operates in the low power mode, the display device 20 continuously operates in the low power mode if any of the detected temperatures TEMPdet(1)~TEMPdet(M) is greater than or equivalent to the temperature threshold TEMPthld, or the display device 20 changes to the normal mode if all of the detected temperatures TEMPdet(1)~TEMPdet(M) are less than the temperature threshold TEMPthld.

Figure 3:
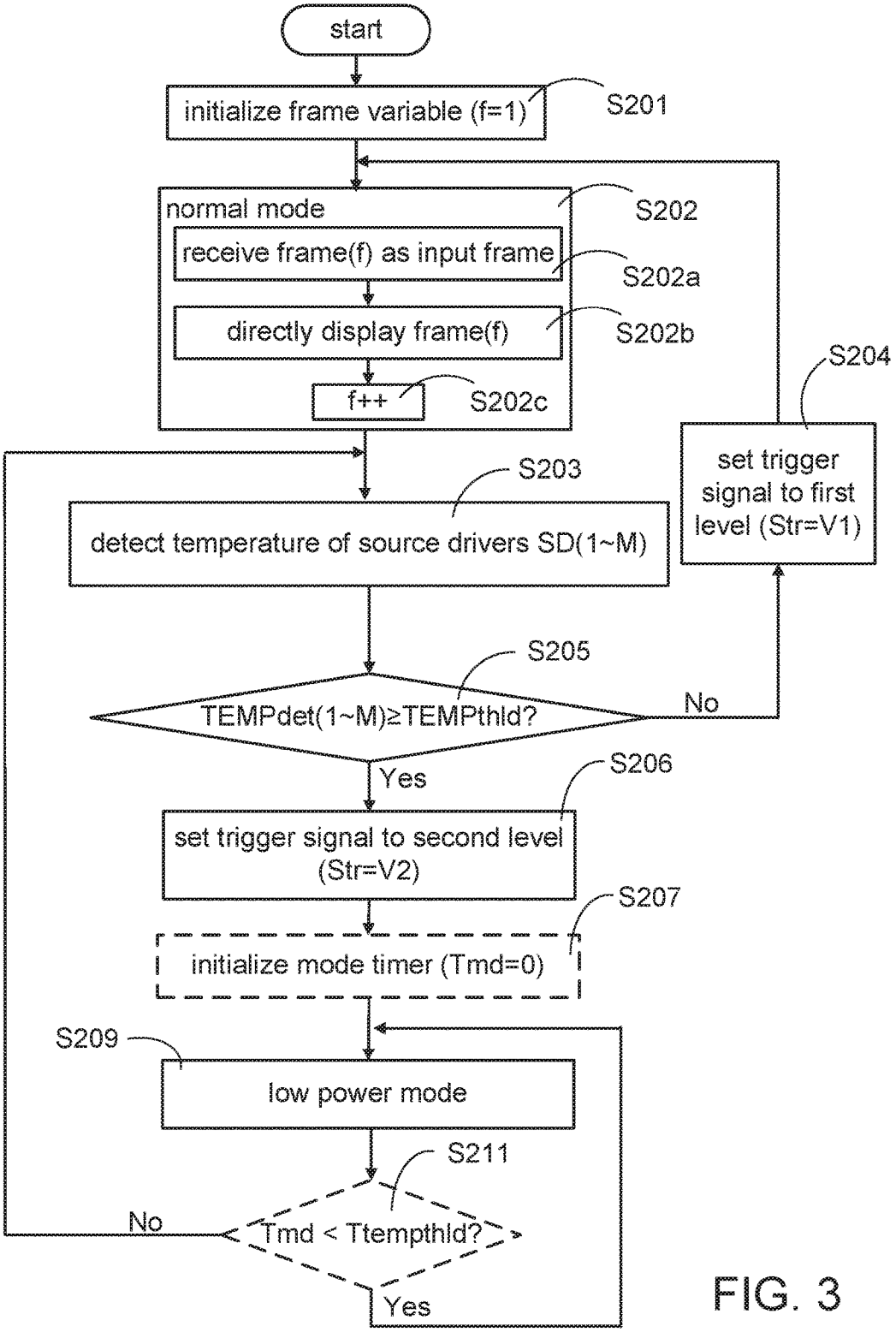
FIG. 3 is a flow diagram illustrating transition between operation modes of the display device according to the present disclosure.

FIG. 3 is a flow diagram illustrating transition between operation modes of the display device according to the present disclosure. The dotted rectangles, that is, steps S207 and S211 are optionally executed.

Firstly, a frame variable f is initialized, that is, f=1 (step S201), and the display device 20 starts to operate in a normal mode (step S202).

The operation of the display device 20 in the normal mode includes following steps. The control circuit 22 receives the f-th frame, represented as frame(f), as a source frame (step S202*a*), and the display panel 29 directly displays the f-th frame frame(f) (step S202*b*). In other words, whenever a source frame is received, the source frame is used as the output frame and is displayed by the display panel 29. Therefore, a source frame rate fInFrame corresponding to the source frame is equivalent to a refresh frame rate fOutFrame corresponding to the output frame when the display device 20 is in the normal mode. That is, fInFrame=fOutFrame. Then, the frame variable f is increased with 1 (step S202*c*).

Then, the temperature detectors 25*a* detect temperature of source drivers SD(1)~SD(M) (step S203) to obtain the detected temperatures TEMPdet(1)~TEMPdet(M). Then, the detected temperatures TEMPdet(1)~TEMPdet(M) are respectively compared with the temperature threshold TEMPthld (step S205). If the comparison circuit 25*b* determines that all the detected temperatures TEMPdet(1)~TEMPdet(M) are lower than the temperature threshold TEMPthld, the trigger signal Str is set to a first level (Str=V1) (step S204). Then, step S202 is repeated executed and the display device 20 remains to operate in the normal mode.

If the comparison circuit 25*b* determines that any of the detected temperatures TEMPdet(1)~TEMPdet(M) is greater than or equivalent to the temperature threshold TEMPthld, the trigger signal Str is set to a second level (Str=V2) (step S206). Later, a mode timer Tmd can be initialized (step S207). Then, the display device 20 enters the low power mode (step S209). Details and variant implementation about operations of step S209 will be illustrated later.

In step S211, the counting result of the mode timer Tmd is compared with a temperature updating time Ttempthld. Use of the mode timer Tmd and the temperature updating time Ttempthld can reduce the frequency of detecting temperatures of source drivers SD(1)~SD(M). The longer the temperature updating time Ttempthld is, the less frequent the temperatures of source drivers SD(1)~SD(M) are detected.

If the counting result of the mode timer Tmd is shorter than the temperature updating time Ttempthld, that is, Tmd<Ttempthld, step S209 is repeated executed and the display device 20 remains to operate in the low power mode. If the counting result of the mode timer Tmd is greater than or equivalent to the temperature updating time Ttempthld, that is, Tmd≥Ttempthld, step S203 is executed and the temperatures of source drivers SD(1)~SD(M) are detected again to obtain another updated set of detected temperatures TEMPdet(1)~TEMPdet(M).

Details about execution of step S209 are illustrated below with two embodiments, and both embodiments have different applications. The concept of the present disclosure is introduced in FIG. 4.

Figure 4:
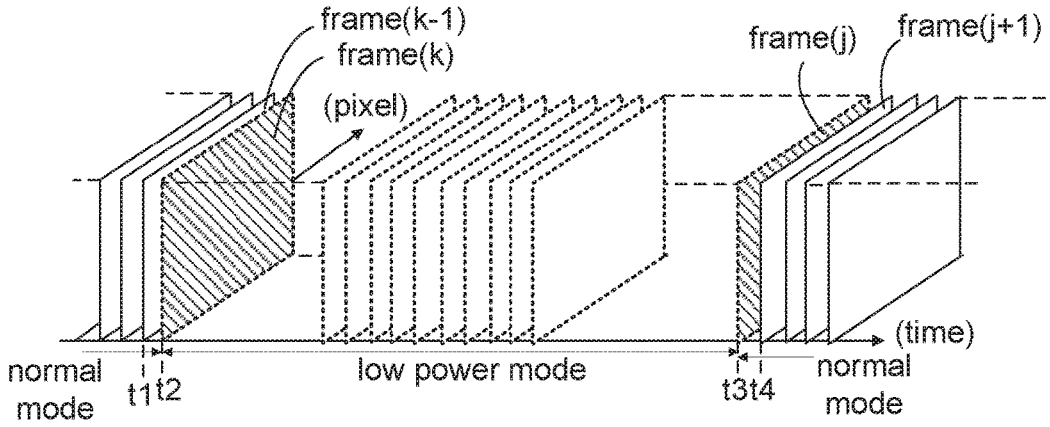
FIG. 4 is a schematic diagram illustrating frame display sequences are changed in response to different operation modes based on the present disclosure.

FIG. 4 is a schematic diagram illustrating frame display sequences are changed in response to different operation modes based on the present disclosure.

Before time point t1, the display device 20 operates in the normal mode. At time point t1, the display device 20 displays the (k−1)-th frame frame(k−1), and at least one of the detected temperatures TEMPdet(1)~TEMPdet(M) is determined to be greater than the temperature threshold TEMPthld. Therefore, the trigger signal Str is set to the second level (Str=V2) at time point t1. When the display device 20 displays the k-th frame frame(k) at time point t2, the display device 20 starts to operate in the low power mode.

Between time point t2 and time point t3, the display device 20 displays the frames in the low power mode. At time point t3, the display device 20 displays the j-th frame frame(j), and all the detected temperatures TEMPdet(1)~TEMPdet(M) are determined to be lower than the temperature threshold TEMPthld. Moreover, the trigger signal Str is set to the first level (Str=V1) at time point t3. After time point t3, the display device 20 starts to return to the normal mode. By the time the display device 20 displays the (j+1)-th frame frame(j+1) at time point t4, the display device 20 is in the normal mode.

According to the present disclosures, display control of output frames are based on a frame set, and each frame set FGP includes at least two frames. A frame set threshold Xthld can be predefined to represent the number of frames being included in the frame set, and the frame set threshold Xthld is between 2 to infinity, that is, $2 \leq N_{frame} < \infty$. For example, in a case that the frame set threshold Xthld is equivalent to 3, each of the frame set FGP includes 3 consecutive frames, and the control circuit repeatedly control display of the frames in a cycle of every 3 frames.

Figure 5:
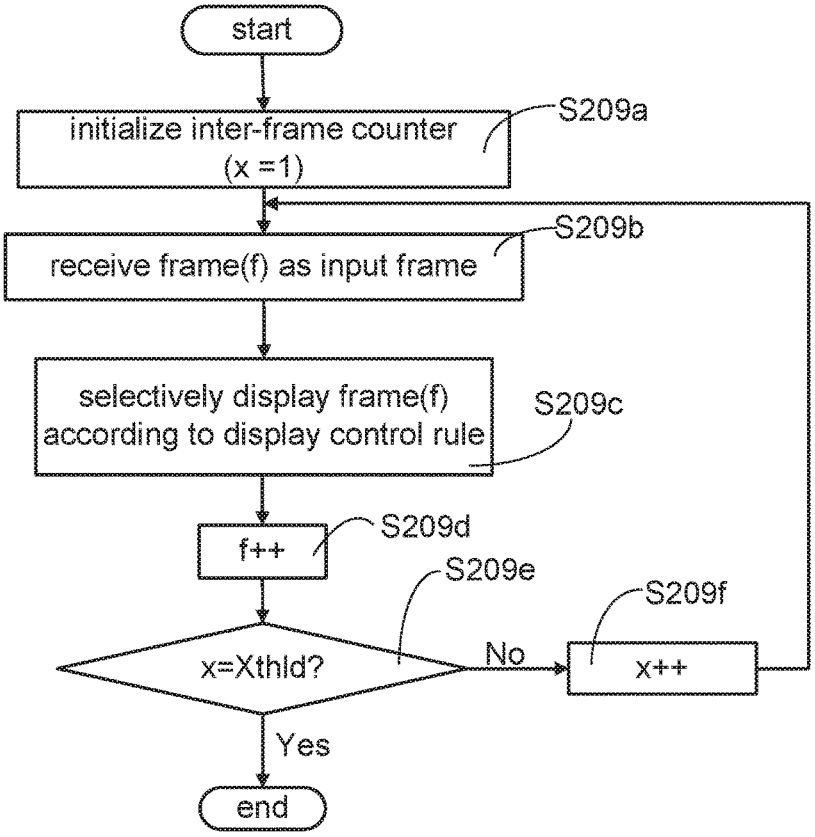
FIG. 5 is a flow diagram illustrating the operation of step S209 in FIG. 3.

FIG. 5 is a flow diagram illustrating the operation of step S209 in FIG. 3. Firstly, an inter-frame counter "x" is initialized to 1, that is, x=1 (step S209*a*), and the timing controller 23 receives the f-th frame frame(f) as the source frame (step S209*b*). Then, the f-th frame frame(f) is selectively displayed according to a display control rule (step S209*c*). Then, the frame variable f is increased with 1 (step S209*d*). The inter-frame counter x is compared with the frame set threshold Xthld (step S209*e*). If the inter-frame counter x is equivalent to the frame set threshold Xthld, the frame set FGP is determined to be completely executed and the flow is complete. Otherwise, the inter-frame counter x is increased with 1 (step S209*f*), and step S209*b* is repeated executed. The flow is repeatedly executed until the display device 20 exits the low power mode and starts to operate in the normal mode.

The display control rule in step S209*c* can be defined in various approaches, and some examples of the display control rule are illustrated below. The display control rule can be applied to sequence of frames in frame sets FGP, and the control circuit 22 recursively adjusts control of displaying the output frames in units of frame sets FGP. Two embodiments of display control rules are proposed below.

According to the first embodiment of display control rule, conditions are predefined to determine whether a frame is selected or not, and analog data voltages corresponding to the selected frames are not updated. In other words, pixel data of the selected frames are not displayed but a previous frame of the selected frames are held and displayed as still data.

According to the second embodiment of display control rule, the output frames are partially updated and conditions are predefined to determine which of horizontal pixel lines in the frames are displayed. When a horizontal pixel line is selected in a frame, the analog data voltages representing the selected horizontal pixel lines are not updated. In consequence, pixel data of the selected horizontal pixel lines of the frame are not displayed but pixel data of the selected horizontal pixel lines of a previous frame is held and displayed as still data.

For the sake of convenience, in following descriptions, when a frame or a horizontal pixel line is described as not displayed, it does not imply that the frame or the horizontal pixel line is black. Instead, it implies that analog data voltages representing the frame or the horizontal pixel line are not updated so that pixel data corresponding to the previous frame or the horizontal pixel line in the previous frame are held and displayed.

Figure 6:
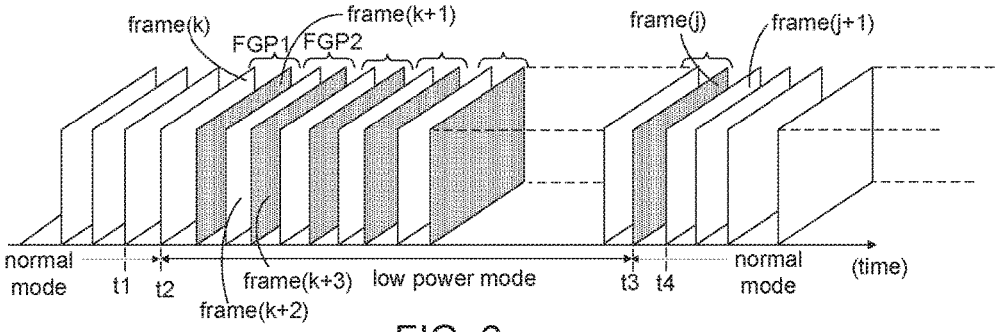
FIG. 6 is a schematic diagram illustrating the frame display sequence according to a first application of the first embodiment of the present disclosure.

FIG. 6 is a schematic diagram illustrating the frame display sequence according to a first application of the first embodiment of the present disclosure. For the sake of convenience, shading is used to represent the frames whose corresponding analog data voltages are not updated so that pixel data of the frames are not displayed.

The display device 20 operates in the normal mode before time point t2. Therefore, all the frames before time point t2 are not shown with shading, and all the frames are displayed when the display device 20 is in the normal mode.

Between time point t2 and time point t3, the display device 20 operates in the low power mode. In this duration, some of the frames between time point t2 and time point t3 are shown with shading and the others are not. Therefore, the frames received between time point t2 and time point t3 are alternatively displayed. Basically, the display device 20 displays the odd-th frames (for example, frame(k), frame (k+2) and so forth) in the low power mode but not display the even-th frames (for example, frame(k+1), frame(k+3) and so forth) in the low power mode.

Between time point t2 and time point t3, frame sets FGP are represented in brackets, and each frame set FGP is assumed to include two frames. Therefore, the frame set threshold Xthld is set to 2 in FIG. 5. For example, frame(k) and frame(k+1) are defined as a first frame set FGP1, and frame(k+2) and frame(k+3) are defined as a second frame set FGP2.

At time point t3, analog data voltages of the last output frame (that is, frame(j)) to be displayed in the low power mode are not updated. At time point t4, the display device 20 returns to the normal mode. Therefore, all the frames after time point t4 are not shown with shading and all frames after time point t4 are displayed.

Figure 7A:
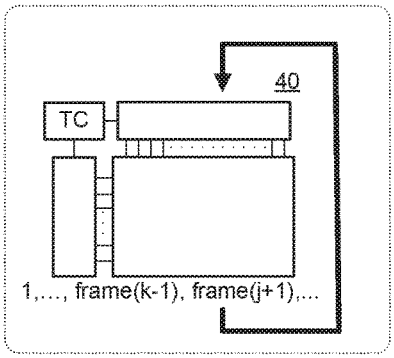
FIG. 7A is a schematic diagram illustrating how the output frames are displayed in the normal mode according to the first application of the first embodiment.

FIG. 7A is a schematic diagram illustrating how the output frames are displayed in the normal mode according to the first application of the first embodiment. When the display device 40 is in the normal mode, analog data voltages representing each frames, for example, frames before time point t2 frame(1) . . . frame(k+1) and frames after time point t4 frame(j+1) . . . , are continuously updated and each of frames after time point t4 is displayed.

Figure 7B:
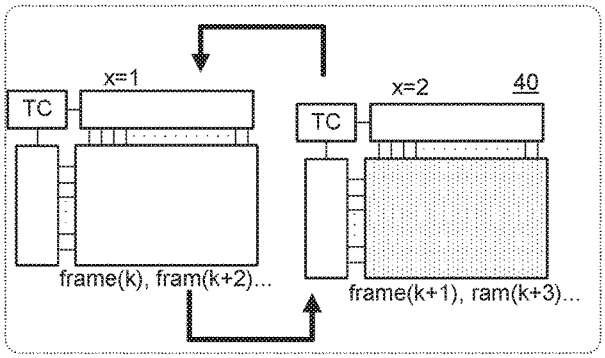
FIG. 7B is a schematic diagram illustrating how the output frames are displayed in the low power mode according to the first application of the first embodiment.

FIG. 7B is a schematic diagram illustrating how the output frames are displayed in the low power mode according to the first application of the first embodiment. Between time point t2 and time point t3 in FIG. 6, the display device 40 alternatively operates according to the left side and the right side of FIG. 7B. The output frames are alternatively updated and displayed.

The left side of FIG. 7B indicates that the pixel data of the k-th frame frame(k), the (k+2)-th frame frame(k+2) and so forth are updated and displayed, and the right of FIG. 7B indicates that the pixel data of the (k+1)-th frame frame(k+1), the (k+3)-th frame frame(k+3) and so forth are not updated. That is, pixel data of the k-th frame frame(k), the (k+2)-th frame frame(k+2) and so forth maintain still for two frame durations ($2\times T_{frame}$).

The display control rule of the display device 40 in the low power mode as shown in FIG. 7B can be summarized and represented in Table 2.

TABLE 2

| frame set (FGP) | frame | Inter-frame counter (x) | x%Xth | selected frame | display of frame |
|---|---|---|---|---|---|
| FGP1 | frame(k) | 1 | 1 | No | Yes |
| | frame(k + 1) | 2 | 0 | Yes | No |
| FGP2 | frame(k + 2) | 1 | 1 | No | Yes |
| | frame(k + 3) | 2 | 0 | Yes | No |

In Table 2, the display control rule is defined based on modulo operation of the inter-frame counter x and the frame set threshold Xthld, that is, the expression x mod Xth (x % Xth). The remainder after division of the inter-frame counter x by the frame set threshold Xthld is further utilized to determine whether a frame is displayed or not.

The first row and the third row in Table 2 respectively represent display control of the k-th frame frame(k) and the (k+2)-th frame frame(k+2). For frame(k) and frame(k+2), the inter-frame counter x is equivalent to 1 and the equation x % Xth=1 is satisfied. Therefore, the k-th frame frame(k) and the (k+2)-th frame frame(k+2) are determined as not selected and the display device 20 displays the k-th frame frame(k) and the (k+2)-th frame frame(k+2).

The second row and the fourth row in Table 2 respectively represent display control of the (k+1)-th frame frame(k+1) and the (k+3)-th frame frame(k+3). For the (k+1)-th frame frame(k+1) and the (k+3)-th frame frame(k+3), the inter-frame counter x is equivalent to 2 and the equation x % Xth=0 is satisfied. Therefore, the (k+1)-th frame frame(k+1) and the (k+3)-th frame frame(k+3) are determined as selected and the display device 20 does not display the (k+1)-th frame frame(k+1) and the (k+3)-th frame frame(k+3).

Figure 8:
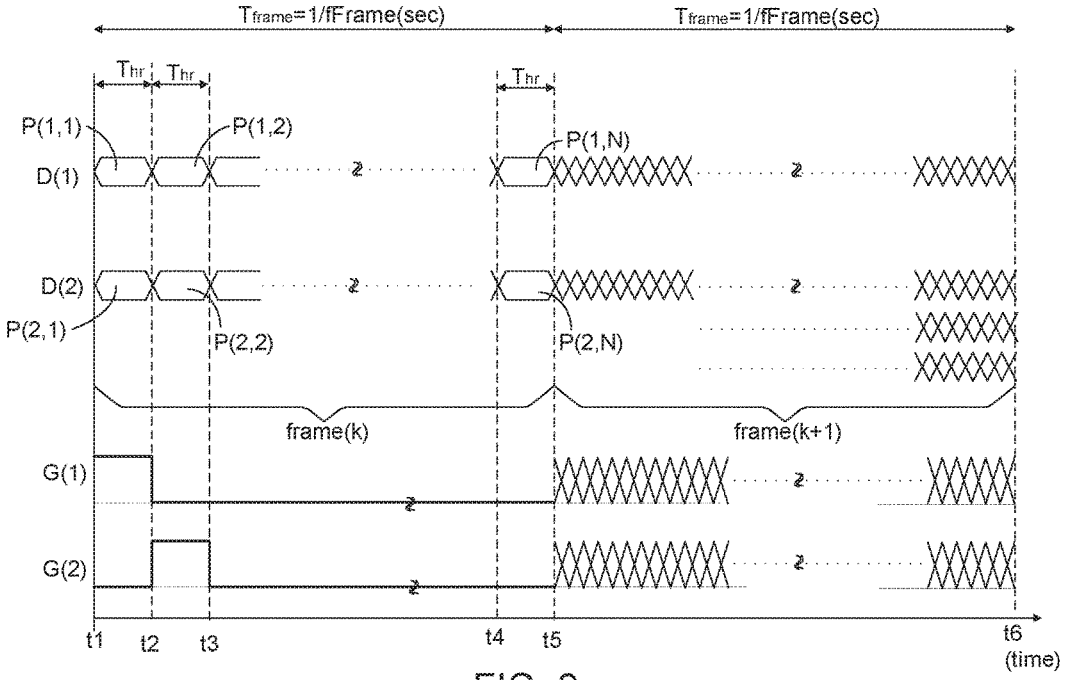
FIG. 8 is a schematic waveform diagram illustrating the first application of the frame-based control rule.

Please refer to FIGS. 6, 7B and 8 together. FIG. 8 is a schematic waveform diagram illustrating the first application of the frame-based control rule. The duration between time point t1 and time point t5 is corresponding to the k-th frame frame(k), and the duration between time point t5 and time point t6 is corresponding to the (k+1)-th frame frame (k+1). In FIG. 8, signals related to four pixels P(1,1), P(1,2), P(2,1), P(2,2) for display frame(k) and frame(k+1) are illustrated.

The duration corresponding to the k-th frame frame(k) is illustrated below. Between time point t1 and time point t2, the TFTs of pixel elements P(1,1) and P(2,1) are turned on because their gate terminal receives the high level of gate line G(1). Meanwhile, data lines D(1) and D(2) respectively transmit the analog data voltage representing pixel data of pixel elements P(1,1) and P(2,1) to the source terminal of the TFTs of pixel elements P(1,1) and P(2,1). Therefore, pixel elements P(1,1) and P(2,1) display their corresponding pixel data between time point t1 and time point t2.

Between time point t2 and time point t3, the TFTs of pixel elements P(1,2) and P(2,2) are turned on because their gate terminals receives the high level of gate line G(2). Meanwhile, data lines D(1) and D(2) respectively transmit the analog data voltage representing pixel data of pixel elements P(1,2) and P(2,2). Therefore, pixel elements P(1,2) and P(2,2) display their corresponding pixel data between time point t2 and time point t3.

The duration corresponding to the (k+1)-th frame frame (k+1) is illustrated below. Between time point t5 and time point t6, all data lines D(1) and D(2) and gate lines G(1) and G(2) are at high impedance. In other words, none of pixel elements P(1,1), P(2,1), P(1,2) and P(2,2) is updated by data lines D(1) and D(2) and pixel data of frame(k+1) are not displayed. Instead of being updated with pixel data between time point t5 and time point t6, pixel elements P(1,1), P(2,1), P(1,2) and P(2,2) continually display pixel data of the k-th frame frame(k) because some charges received between time point t1 and time point t5 are left in their capacitors. Therefore, the user can still watch the k-th frame frame(k) between time point t5 and time point t6.

In conclusion, the display device 40 does not display all the received frames but displays one of every two consecutive source frames. In a case that the display device 40 receives the source frames with a source frame rate (fInFrame) of 120 PFS (fInFrame=120), the display device 40 displays output frames with a refresh frame rate of 60 PFS (fOutFrame=60). In other words, the refresh frame rate fOutFrame is lower than the source frame rate fInFrame (fOutFrame<fInFrame) so that frequencies that capacitors of source drivers SD(1)~SD(M) are charged become lower. Once the capacitors of source drivers SD(1)~SD(M) are charged less often, the power consumption and temperature of the source drivers can gradually decrease.

The display device 40 lowers the refresh frame rate fOutFrame in the low power mode ensures the user can continuously watch the video without interruption while the power consumption of the source drivers SD(1)~SD(M) can be lowered. Therefore, the present disclosure can lower the temperature of the source drivers SD(1)~SD(M) and continuously display frames at the meanwhile.

In practical application, the refresh frame rate fOutFrame can be freely determined by defining different display control rules. Another two applications of the first embodiment are respectively shown in FIGS. 9 and 10.

Figure 9:
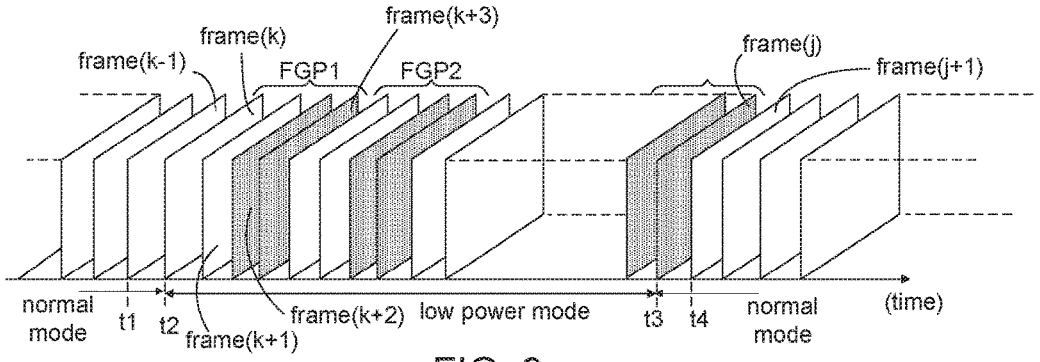
FIG. 9 is a schematic diagram illustrating the frame display sequence according to a second application of the first embodiment.

FIG. 9 is a schematic diagram illustrating the frame display sequence according to a second application of the first embodiment. In FIG. 9, the frame set threshold Xthld is defined as 4, and the refresh frame rate fOutFrame is equivalent to half of the source frame rate fInFrame, that is, fOutFrame=0.5×fInFrame. The display control rule of the low power mode in FIG. 9 can be represented as Table 3.

TABLE 3

| frame set (FGP) | frame | X | x%Xth | selected frame | display of frame |
|---|---|---|---|---|---|
| FGP1 | frame(k) | 1 | 1 | No | Yes |
| | frame(k + 1) | 2 | 2 | No | Yes |
| | frame(k + 2) | 3 | 3 | Yes | No |
| | frame(k + 3) | 4 | 0 | Yes | No |

The display control rule shown in Table 3 can be summarized as below. In a case that a frame is corresponding to x % Xth=1 or x % Xth=2, the frame is not selected, and the frame is normally displayed. In a case that a frame is corresponding to x % Xth=3 or x % Xth=0, the frame is defined as selected and pixel data of the frame is not updated.

The first row in Table 3 represents display control of the k-th frame frame(k). For the k-th frame frame(k), the inter-frame counter x is equivalent to 1 and x % Xth=1. Therefore, the k-th frame frame(k) is determined as not selected and the display device 20 displays the k-th frame frame(k).

The second row in Table 3 represents display control of the (k+1)-th frame frame(k+1). For the (k+1)-th frame frame(k+1), the inter-frame counter x is equivalent to 2 and x % Xth=2. Therefore, the (k+1)-th frame frame(k+1) is determined as not selected and the display device 20 displays the (k+1)-th frame frame(k+1).

The third row in Table 3 represents display control of the (k+2)-th frame frame(k+2). For the (k+2)-th frame frame (k+2), the inter-frame counter x is equivalent to 3 and x % Xth=3. Therefore, the (k+2)-th frame frame(k+2) is selected to be suspended and the display device 20 does not display the (k+2)-th frame frame(k+2).

The fourth row in Table 3 represents display control of the (k+3)-th frame frame(k+3). For the (k+3)-th frame frame (k+3), the inter-frame counter x is equivalent to 4 and x % Xth=0. Therefore, the (k+3)-th frame frame(k+3) is selected to be suspended and the display device 20 does not display the (k+3)-th frame frame(k+3).

In conclusion, the display device 20 does not display all the received frames but displays two of every four consecutive source frames. In a case that the display device 20 receives the source frames with a source frame rate (fInFrame) of 120 PFS (fInFrame=120), the display device 20 displays output frames with a refresh frame rate of 60 PFS (fOutFrame=60).

Although the relationship of the refresh frame rate fOutFrame and the source frame rate fInFrame in FIGS. 6 and 9 are similar, that is, fOutFrame=0.5×fInFrame, the practical implementation are different. Therefore, the implementation of the present disclosure is relatively flexible.

Figure 10:
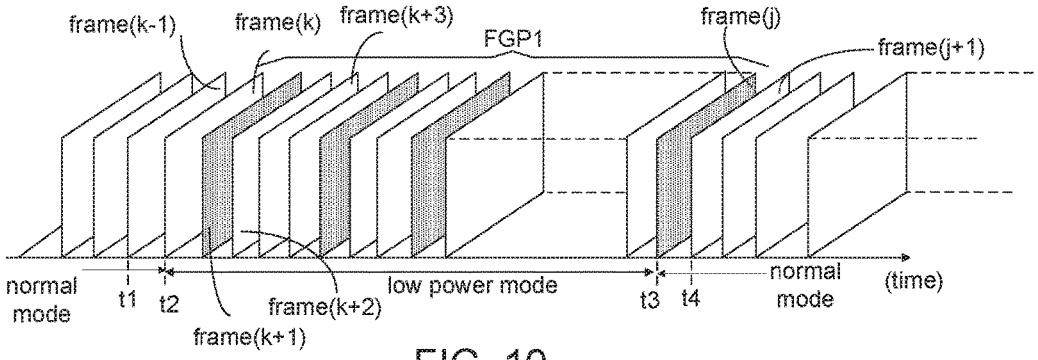
FIG. 10 is a schematic diagram illustrating the frame display sequence according to a third application of the first embodiment.

FIG. 10 is a schematic diagram illustrating the frame display sequence according to a third application of the first embodiment. In FIG. 10, only one frame set FGP is defined and the frame set threshold Xthld is assume to be equivalent to infinity (Xth=∞).

In FIG. 10, the display control rule is based on a random sequence of numbers and pixel data of frames corresponding to the numbers in the random sequence are not displayed. For example, in a case that the random sequence includes numbers of 2, 6, 9 . . . , frames frame(k+1), frame(k+5) and frame(k+8) are defined as selected and analog data voltages representing frame(k+1), frame(k+5) and frame(k+8) are not conducted to pixel elements P(1,1)~P(M,N). Therefore, capacitors of pixel elements P(1,1)~P(M,N) are not charged by the analog data voltages through data lines D(1)~D(M) for the duration corresponding to frames frame(k+1), frame (k+5) and frame(k+8).

A second embodiment of display control rule implies that the display device 20 adjusts display control of the frames in units of horizontal pixel lines, and applications of the second embodiment are illustrated in FIGS. 11-16. According to the second embodiment of display control rule, the inter-frame counter x and a horizontal line counter y are defined to respectively represent the order of a frame in the frame set FGP and the order of a horizontal pixel line in a frame. Depending on their horizontal positions and changes of frames, the pixel elements P(1,1)~P(M,N) are selectively updated or not updated with latest pixel data based on value of the inter-frame counter x and value of the horizontal line counter y.

Figure 11:
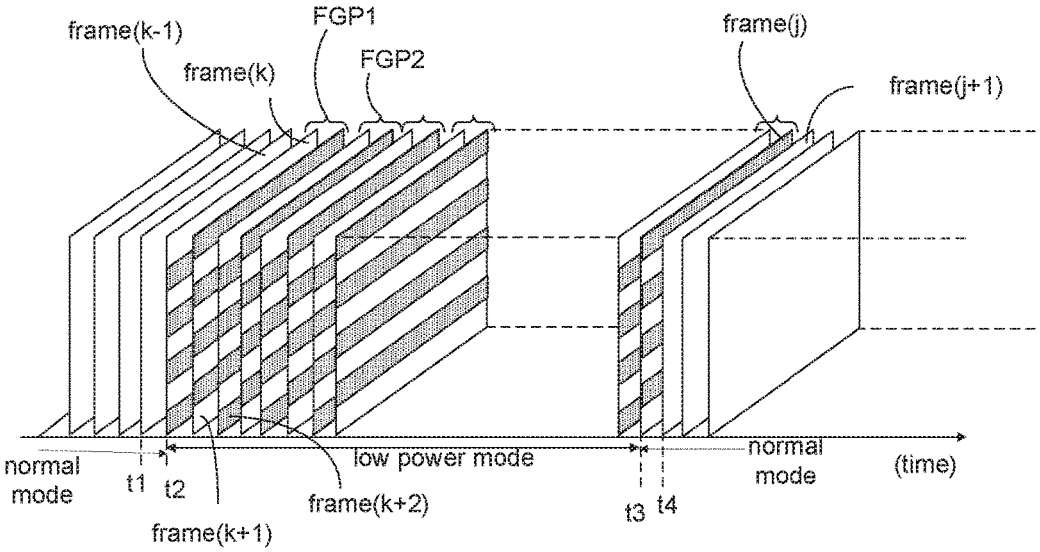
FIG. 11 is a schematic diagram illustrating the frame display sequence according to a first application of the second embodiment of the present disclosure.

FIG. 11 is a schematic diagram illustrating the frame display sequence according to a first application of the second embodiment of the present disclosure. For the sake of convenience, shading is used to represent the horizontal pixel lines whose corresponding analog data voltages are not updated.

The horizontal pixel lines of frames between time point t2 and time point t3 are shown with alternative shading. Between time point t2 and time point t3, frame sets FGP are represented in brackets, and each frame set FGP is assumed to include two frames. Therefore, the frame set threshold Xthld is set to 2 in FIG. 11. For example, the k-th frame frame(k) and the (k+1)-th frame frame(k+1) are defined as a first frame set FGP1, and the (k+2)-th frame frame(k+2) and the (k+3)-th frame frame(k+3) are defined as a second frame set FGP2.

Figure 12:
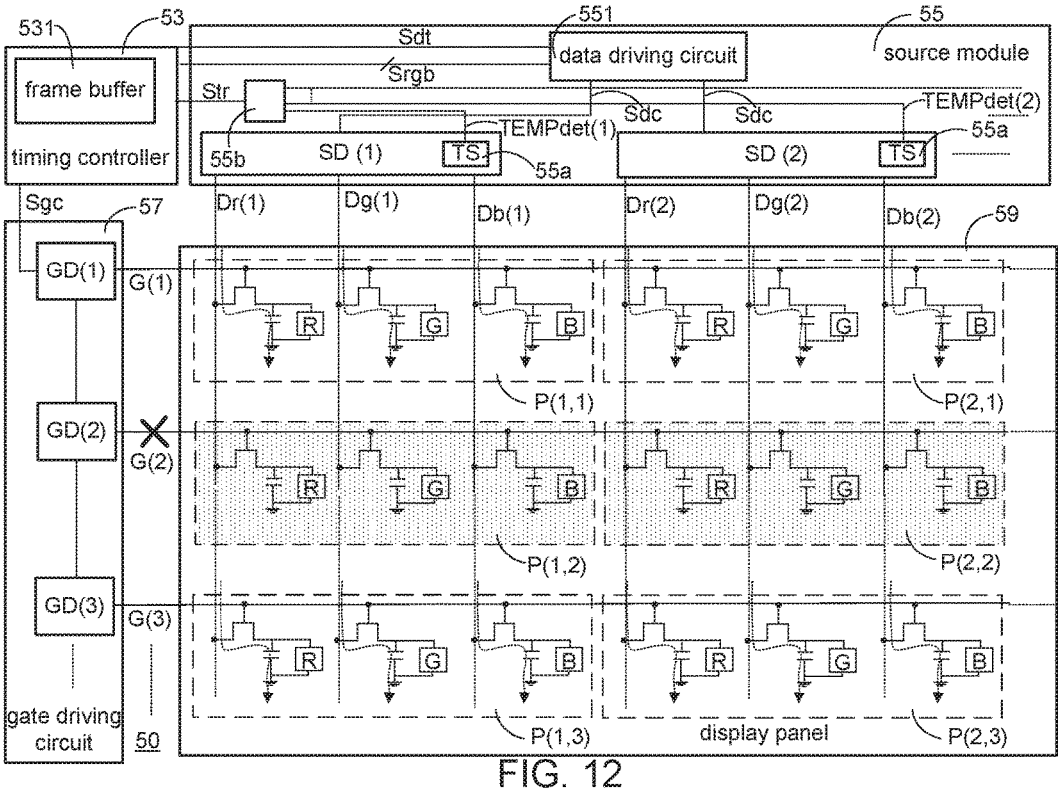
FIG. 12 is a schematic diagram illustrating the output frame is updated according to the first application of the horizontal pixel line-based control rule.
Figure 13:
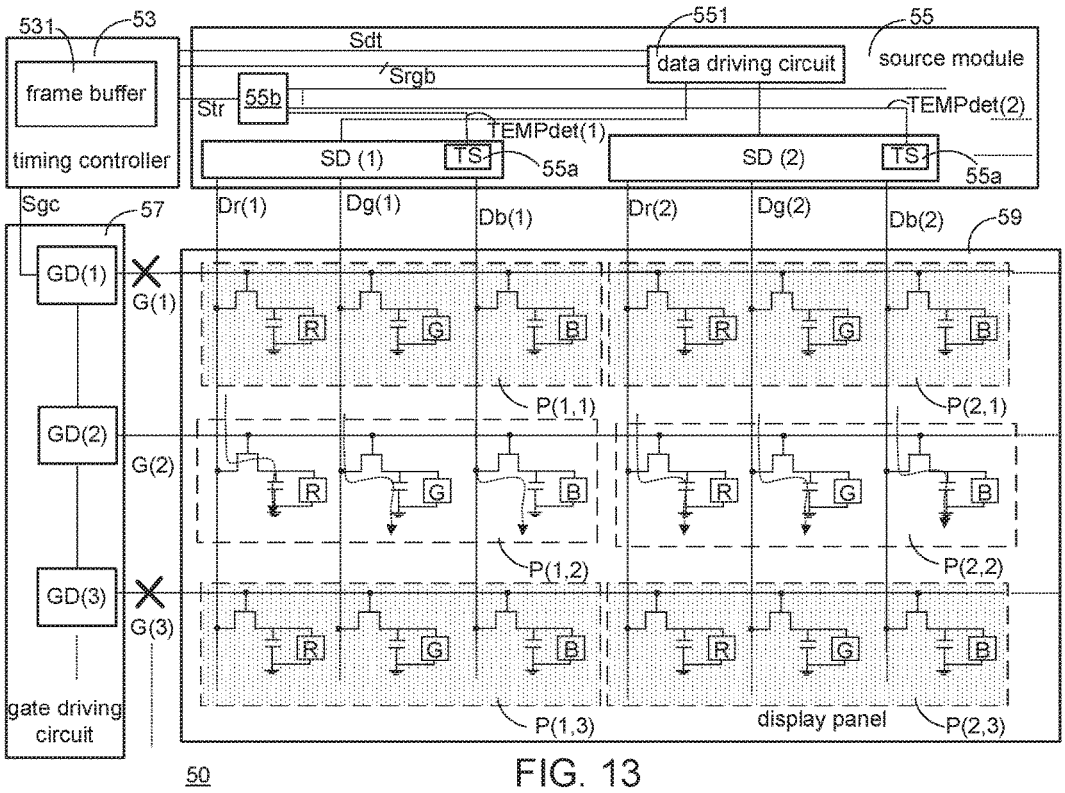
FIG. 13 is a schematic diagram illustrating the output frame is not updated according to the first application of the horizontal pixel line-based control rule.

Operations of the display device in the low power mode as shown in FIG. 11 are further described in FIGS. 12 and 13. FIG. 12 is corresponding to the odd-th frames in the low power mode, for example, frame(k), frame(k+2) and so forth. FIG. 13 is corresponding to the even-th frames in the low power mode, for example, frame(k+1), frame(k+3) and so forth.

FIG. 12 is a schematic diagram illustrating the output frame is updated according to the first application of the horizontal pixel line-based control rule. FIG. 12 is corresponding to odd-th frames in the low power mode in FIG. 11, for example, frame(k), frame(k+2) and so forth. For these odd-th frames, pixel data of the odd-th horizontal pixel lines are displayed but pixel data of the even-th horizontal pixel lines are not displayed.

Data line Dr(1) transmits analog data voltage to red sub-pixel (R) of pixel elements P(1,1) and P(1,2). Data line Dg(1) transmits analog data voltage to green sub-pixel (G)

of pixel elements P(1,1) and P(1,2). Data line Db(1) transmits analog data voltage to blue sub-pixel (B) of pixel elements P(1,1) and P(1,2). Similarly, data lines Dr(2), Dg(2) and Db(2) respectively transmit analog data voltage to the red sub-pixel (R), the green sub-pixel (G), and the blue sub-pixel (B) of pixel elements P(2,1) and P(2,2).

In FIG. 12, gate lines G(1) and G(3) respectively generate gate pulses to pixel elements P(1,1) and P(2,1), and pixel elements P(1,3) and P(2,3). Therefore, analog data voltage of data lines Dr(1), Dg(1), Db(1) are conducted to capacitors of pixel elements P(1,1) and P(1,3), and analog data voltage of data lines Dr(2), Dg(2), Db(2) are conducted to capacitors of pixel elements P(2,1) and P(2,3).

On the other hand, gate line G(2) does not generate gate pulse to pixel elements P(1,2) and P(2,2). Therefore, analog data voltage of data lines Dr(1), Dg(1), Db(1) are not conducted to capacitors of pixel elements P(1,2) and P(1,2). In FIG. 12, pixel elements P(1,2) and P(2,2) are thus shown with shading.

FIG. 13 is a schematic diagram illustrating the output frame is not updated according to the first application of the horizontal pixel line-based control rule. FIG. 13 is corresponding to even-th frames in the low power mode in FIG. 11, for example, the (k+1)-th frame(k+1), the (k+3)-th frame(k+3) and so forth. For these even-th frames, pixel data of the even-th horizontal pixel lines are displayed but pixel data of the odd-th horizontal pixel lines are not displayed.

Data line Dr(1) transmits analog data voltage to red sub-pixel (R) of pixel elements P(1,1) and P(1,2). Data line Dg(1) transmits analog data voltage to green sub-pixel (G) of pixel elements P(1,1) and P(1,2). Data line Db(1) transmits analog data voltage to blue sub-pixel (B) of pixel elements P(1,1) and P(1,2). Similarly, data lines Dr(2), Dg(2) and Db(2) respectively transmit analog data voltage to the red sub-pixel (R), the green sub-pixel (G), and the blue sub-pixels (B) of pixel elements P(2,1) and P(2,2).

In FIG. 13, gate lines G(1) and G(3) do not generate gate pulse to pixel elements P(1,1) and P(2,1), and pixel elements P(1,3) and P(2,3). Therefore, analog data voltage of data lines Dr(1), Dg(1), Db(1) are not conducted to capacitors of pixel elements P(1,1) and P(1,3), and analog data voltage of data lines Dr(2), Dg(2), Db(2) are not conducted to capacitors of pixel elements P(2,1) and P(2,3). In FIG. 13, pixel elements P(1,1), P(1,3), P(2,1) and P(2,3) are thus shown with shading.

On the other hand, gate line G(2) generates gate pulse to pixel elements P(1,2) and P(2,2). Therefore, analog data voltage of data lines Dr(1), Dg(1), Db(1) are conducted to capacitors of pixel elements P(1,2) and P(2,2).

Figure 14:
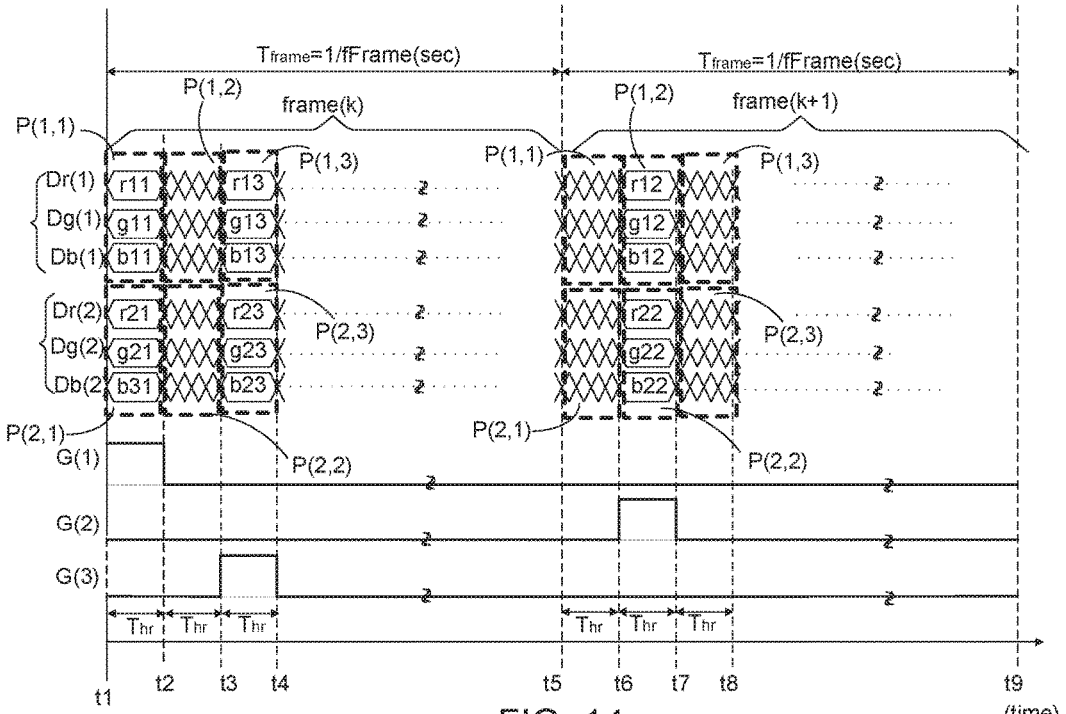
FIG. 14 is a schematic waveform diagram illustrating the first application of horizontal pixel line-based control rule.

FIG. 14 is a schematic waveform diagram illustrating the first application of horizontal pixel line-based control rule. In FIG. 14, the duration between time point t1 and time point t5 is corresponding to the k-th frame frame(k), and the duration between time point t5 and time point t9 is corresponding to the (k+1)-th frame frame(k+1).

During time point t1 and time point t2, the TFTs of pixel elements P(1,1) and P(2,1) are turned on because gate line G(1) is at high level. Meanwhile, data lines Dr(1), Dg(1) and Db(1) respectively transmits the analog data voltage representing the red sub-pixel data r11, the green sub-pixel data g11, and the blue sub-pixel data b11 to the red sub-pixel, the green sub-pixel and the blue sub-pixel of pixel element P(1,1). Moreover, data lines Dr(2), Dg(2) and Db(2) respectively transmits the analog data voltage representing the red sub-pixel data r21, the green sub-pixel data g21, and the blue sub-pixel data b21 to the red sub-pixel, the green sub-pixel and the blue sub-pixel of pixel element P(2,1). Therefore, the sub-pixels of pixel elements P(1,1) and P(2,1) normally display between time point t1 and time point t2.

During time point t2 and time point t3, the TFTs of pixel elements P(1,1), P(2,1), P(1,2), P(2,2), P(1,3) and P(2,3) are all turned off because gate lines G(1), G(2) and G(3) are all at low level. Meanwhile, data lines Dr(l), Db(1), Db(1), Dr(2), Dg(2) and Db(2) do not provide analog data voltage to pixel elements P(1,1), P(2,1), P(1,2), P(2,2), P(1,3) and P(2,3).

During time point t3 and time point t4, the TFTs of pixel elements P(1,3) and P(2,3) are turned on because gate line G(3) is at high level. Meanwhile, data lines Dr(1), Dg(1) and Db(1) respectively transmit the analog data voltage representing the red sub-pixel data r13, the green sub-pixel data g13, and the blue sub-pixel data b13 to the red sub-pixel, the green sub-pixel and the blue sub-pixel of pixel element P(1,3). Moreover, data lines Dr(2), Dg(2) and Db(2) respectively transmit the analog data voltage representing the red sub-pixel data r23, the green sub-pixel data g23, and the blue sub-pixel data b23 to the red sub-pixel, the green sub-pixel and the blue sub-pixel of pixel element P(2,3). Therefore, the sub-pixels of pixel elements P(1,3) and P(2,3) operate regularly between time point t3 and time point t4.

The duration corresponding to frame(k+1) is illustrated below. During time point t5 and time point t6, pixel elements P(1,1), P(2,1), P(1,2), P(2,2), P(1,3) and P(2,3) are turned off because gate lines G(1), G(2) and G(3) are at low level. Meanwhile, data lines Dr(1), Db(1), Db(1), Dr(2), Dg(2) and Db(2) do not provide analog data voltage to pixel elements P(1,1), P(2,1), P(1,2), P(2,2), P(1,3) and P(2,3).

During time point t6 and time point t7, the TFTs of pixel elements P(1,1), P(2,1), P(1,3) and P(2,3) are turned off because gate lines G(1) and G(3) are at low level. On the other hand, the TFTs of pixel elements P(1,2) and P(2,2) are turned on because gate line G(2) is at high level. Meanwhile, data lines Dr(1), Dg(1) and Db(1) respectively transmit the analog data voltage representing the red sub-pixel data r12, the green sub-pixel data g12, and the blue sub-pixel data b12 to the red sub-pixel, the green sub-pixel and the blue sub-pixel of pixel element P(1,2). Moreover, data lines Dr(2), Dg(2) and Db(2) respectively transmit the analog data voltage representing the red sub-pixel data r22, the green sub-pixel data g22, and the blue sub-pixel data b22 to the red sub-pixel, the green sub-pixel and the blue sub-pixel of pixel element P(2,2). Therefore, the sub-pixels of pixel elements P(1,2) and P(2,2) operate regularly between time point t6 and time point t7.

During time point t7 and time point t8, the TFTs of pixel elements P(1,1), P(2,1), P(1,2), P(2,2), P(1,3) and P(2,3) are turned off because t gate lines G(1), G(2) and G(3) are at low level. Meanwhile, data lines Dr(1), Db(1), Db(1), Dr(2), Dg(2) and Db(2) do not provide analog data voltage to pixel elements P(1,1), P(2,1), P(1,2), P(2,2), P(1,3) and P(2,3).

According to the above illustrations, pixel elements P(1,1)~P(M,1) and P(1,3)~P(M,3) arranged at the first horizontal pixel line and the third horizontal pixel line display pixel data of frame(k), but pixel elements P(1,1)~P(M,1) and P(1,3)~P(M,3) do not display pixel data of frame(k+1). Relatively, pixel elements P(1,2)~P(M,2) arranged at the second horizontal pixel line display pixel data of frame(k+1), but pixel elements P(1,2)~P(M,2) do not display pixel data of frame(k). In other words, pixel elements display pixel data in one of every two frames. In consequence, refresh frame rate of the analog data voltages representing the output frames is reduced to half of the source frame rate and the temperature of the source drivers can be decreased.

For the second embodiment of the present disclosure, a horizontal line counter y and a line set threshold Ythld are defined. The range of the line set threshold Ythld is between 2 to the number of horizontal lines Htotal included in the frame. The display control rule of the first application of the second embodiment (FIGS. 11~14) can be represented as Table 4.

TABLE 4

| frame set (FGP) | frame | x | y | h | y % Ythld | selected horizontal pixel line | display of h-th horizontal pixel line |
|---|---|---|---|---|---|---|---|
| FGP1 | frame(k) | 1 | 1 | odd | 1 | No | Yes |
| | | | 2 | even | 0 | Yes | No |
| | frame(k + 1) | 2 | 1 | odd | 1 | Yes | No |
| | | | 2 | even | 0 | No | Yes |

In Table 4, the display control rule is defined based on the modulo operation of the horizontal line counter y and the line set threshold Ythld, that is, the expression y mod Ythld (y % Ythld). The remainder after division of the horizontal line counter y by the line set threshold Ythld is further utilized to determine whether a line in the frame is displayed or not.

The first row and the second row in Table 4 represent display control of frame(k). For frame(k), the inter-frame counter x is equivalent to 1. Moreover, the odd-th horizontal pixel lines of frame(k) are not selected, and the even-th horizontal pixels of frame(k) are selected. Therefore, for frame(k), the horizontal pixel lines that match the equation y % Ythld=1 are not selected but displayed, and the horizontal pixel lines match the equation y % Ythld=0 are selected but not displayed.

The third row and the fourth row in Table 4 represent display control of frame(k+1). For frame(k+1), the inter-frame counter x is equivalent to 2. Moreover, the odd-th horizontal pixel lines of frame(k) are selected, and the even-th horizontal pixels of frame(k) are not selected. Therefore, for frame(k+1), the horizontal pixel lines that match the equation y % Ythld=1 are selected but not displayed, and the horizontal pixel lines match the equation y % Ythld=0 are not selected but displayed.

As shown in Table 4, display of an h-th line in an f-th frame is jointly determined according to the order of the count variable y in the frame and the order of the inter-frame counter x in the frame set FGP. The display control rule in Table 4 can be further concluded as below. For frames corresponding to the inter-frame counter x equivalent to 1, the horizontal pixel lines are selected when the predefined condition y % Ythld=0 is satisfied. For frames corresponding to the inter-frame counter x equivalent to 2, the horizontal pixel lines are selected when the predefined condition y % Ythld=1 is satisfied. Alternatively speaking, the predefined condition is defined based on the value of the inter-frame counter x and value of the horizontal line counter y.

Figure 15:
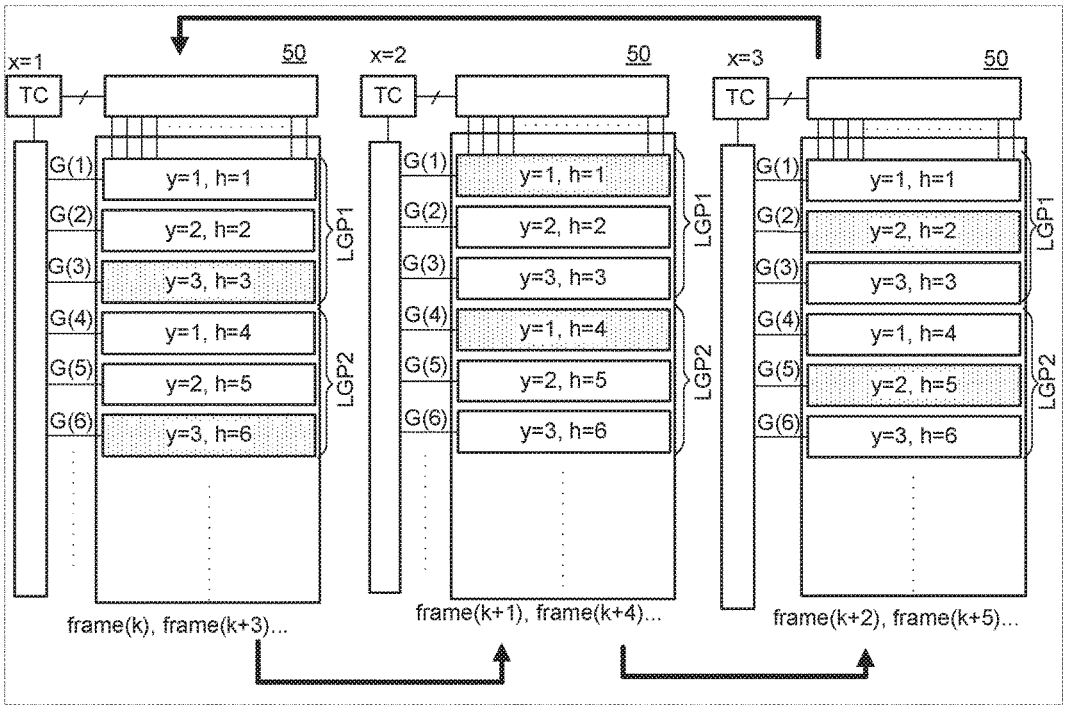
FIG. 15 is a schematic diagram illustrating a second application of the second embodiment.

The application of the horizontal pixel line-based control rule may vary, and the frame set threshold Xth may vary. Another display control rule of the low power mode is illustrated as an example. In FIG. 15, the frame set threshold Xthld and the line set threshold Ythld are predefined to be equivalent to 3. In practical application, the frame set threshold Xthld and the line set threshold Ythld can be equivalent or different.

FIG. 15 is a schematic diagram illustrating a second application of the second embodiment. The display control rule is repeatedly and recursively applied to the display device 50. At the left, middle, and right of FIG. 15, display control corresponding to the frames with the inter-frame counter x=1, x=2, and x=3 are respectively shown. The display control rule of FIG. 16 can be represented as Table 5.

TABLE 5

| Frame set (FGP) | frame | x | y | h | y % Ythld | Selected line | display of h-th horizontal pixel line |
|---|---|---|---|---|---|---|---|
| FGP1 | frame(k) | 1 | 1 | 1, 4, . . . | 1 | No | Yes |
| | | | 2 | 2, 5, . . . | 2 | No | Yes |
| | | | 3 | 3, 6 . . . | 0 | Yes | No |
| | frame(k + 1) | 2 | 1 | 1, 4, . . . | 1 | Yes | No |
| | | | 2 | 2, 5, . . . | 2 | No | Yes |
| | | | 3 | 3, 6, . . . | 0 | No | Yes |
| | frame(k + 2) | 3 | 1 | 1, 4, . . . | 1 | No | Yes |
| | | | 2 | 2, 5, . . . | 2 | Yes | No |
| | | | 3 | 3, 6, . . . | 0 | No | Yes |

The first three rows in Table 5 are corresponding to the left side of FIG. 15. For frames corresponding to x=1, for example, the k-th frame frame(k) and the (k+3)-th frame frame(k+3), the horizontal pixel lines with row number that is corresponding to multiple of three, for example, the $3^{rd}$ horizontal pixel line and the $6^{th}$ horizontal pixel line, are defined as selected and pixel data of these horizontal pixel lines of frames frame(k) and frame(k+3) are not displayed.

The second three rows in Table 5 are corresponding to the middle of FIG. 15. For frames corresponding to x=2, for example, the (k+1)-th frame frame(k+1) and the (k+4)-th frame frame(k+4), the horizontal pixel lines corresponding to a horizontal line counter y satisfying y % Yth=1, for example, the $1^{st}$ horizontal pixel line and the $4^{th}$ horizontal pixel line, are defined as selected and pixel data of these horizontal pixel lines of frames frame(k+1) and frame(k+4) are not displayed.

The third three rows in Table 5 are corresponding to the right side of FIG. 15. For frames corresponding to x=3, for example, the (k+2)-th frame frame(k+2) and the (k+5)-th frame frame(k+5), the horizontal pixel lines corresponding to a horizontal line counter y satisfying y % Yth=2, for example, the $2^{nd}$ horizontal pixel line and the $5^{th}$ horizontal pixel line, are defined as selected and pixel data of these horizontal pixel lines of frames frame(k+2) and frame(k+5) are not displayed.

Figure 16:
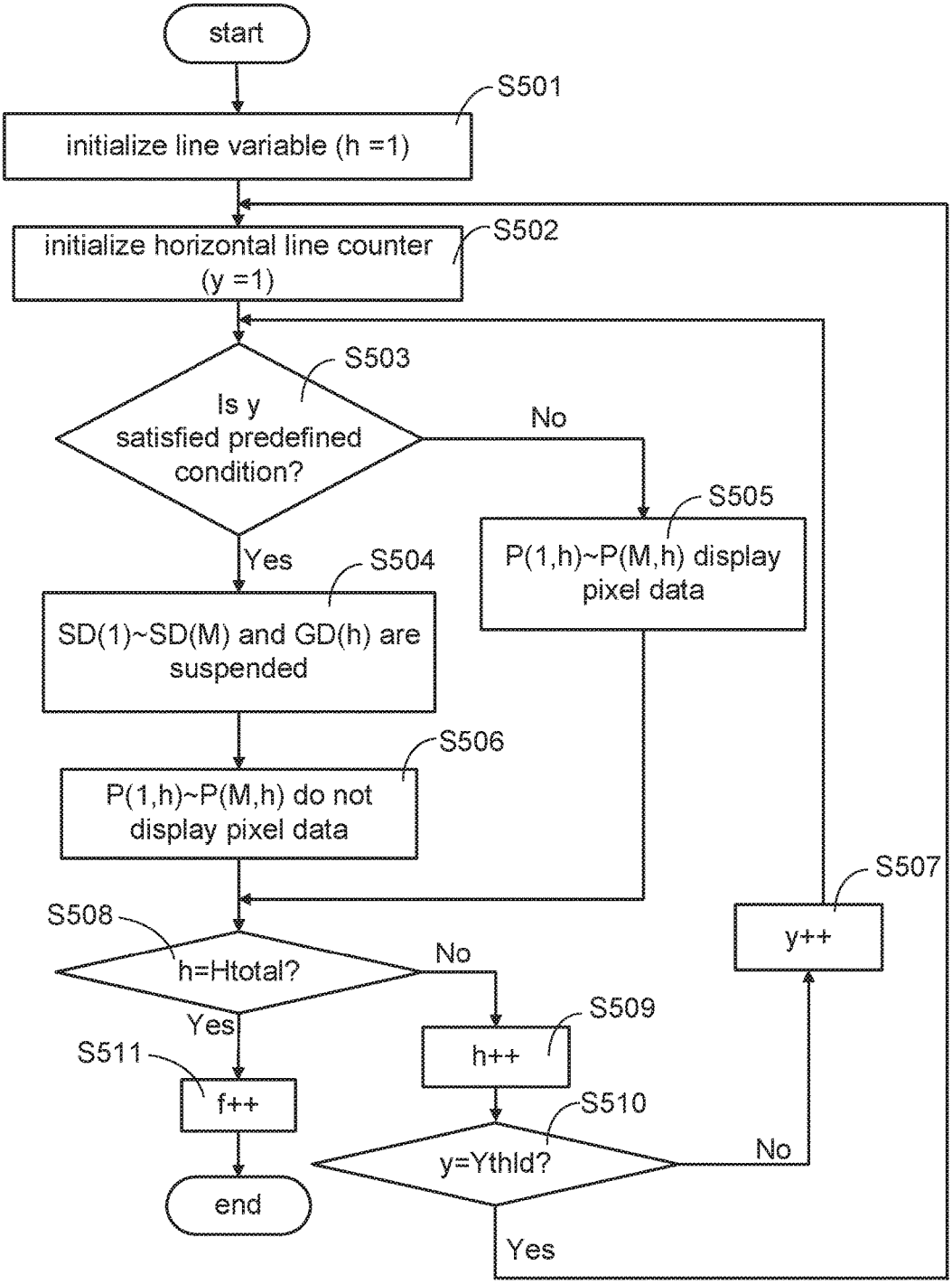
FIG. 16 is a flow diagram illustrating the second embodiment based on the horizontal pixel line-based control rule.

FIG. 16 is a flow diagram illustrating the second embodiment based on the horizontal pixel line-based control rule. The flow shown in FIG. 16 is describes details of step S209*c* in FIG. 5 based on the second embodiment of the present disclosure.

Firstly, a line variable h and a horizontal line counter y are initialized (steps S501 and S502). Then, whether the horizontal line counter y is satisfied with a predefined condition is determined (step S503).

If the determination result of step S503 is negative, the h-th horizontal pixel line is not selected and pixel elements arranged at the h-th horizontal pixel line are controlled to display pixel data of the h-th horizontal pixel line of the f-th frame (step S505). If the determination result of step S503 is positive, the h-th horizontal pixel line is determined as being selected. In consequence, source drivers SD(1)~SD(M) and gate driver GD(h) corresponding to the h-th horizontal pixel line are suspended (step S504) and pixel elements P(1,h)~P(M,h) arranged at the h-th horizontal pixel line are controlled not to display pixel data of the h-th horizontal pixel line of the f-th frame (step S506).

Then, whether display of the output frame is complete is determined, and the line count variable h is compared with the number of horizontal lines of the display panel Htotal (step S508). If the determination result of step S508 is positive, the frame variable f is increased with 1 (step S511) and the flow ends. The number of horizontal lines of the display panel Htotal is determined according to the vertical resolution of the display device 50. For example, if the display device 50 has a resolution of 1920×1080, the number of horizontal lines of the display panel Htotal is equivalent to 1080.

If the deamination result of step S508 is negative, the line variable h is increased with 1 (step S509). Then, it is determined whether the horizontal line counter y is equivalent to the line set threshold Ythld (step S510). If the determination result of step S510 is positive, step S502 is repeatedly executed. If the determination result of step S510 is negative, the horizontal line counter y is increased with 1 (step S507) and step S503 is repeatedly executed.

In conclusion, the refresh frame rate of the display device can be selectively controlled to be lower than the source frame rate, and different embodiments represents approaches based on the frame-based control rule and the horizontal line-based control rule are provided. By lowering the refresh frame rate, the high temperature issue of source drivers can be solved. In practical application, the display device may support various display control rules and several temperature threshold can be set to combine different display control rules. With the dynamic adjustment function, the temperature of the source drivers can be lowered in the low power mode while the display device can continuously display.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A display device, comprising:

a control circuit, for receiving a plurality of source frames with a source frame rate, wherein the control circuit generates a plurality of data signals and a plurality of gate signals based on the plurality of source frames; and a display panel, electrically connected to the control circuit, for displaying a plurality of output frames with one of a first refresh frame rate or a second refresh frame rate, wherein the plurality of output frames are displayed according to the plurality of data signals and the plurality of gate signals, wherein the source frame rate is equivalent to the first refresh frame rate, and the source frame rate is greater than the second refresh frame rate, wherein when the display device displays the plurality of output frames with the first refresh frame rate, the control circuit continuously transmits the plurality of data signals and the plurality of gate signals to the display panel; and when the display device displays the plurality of output frames with the second refresh frame rate, the control circuit selectively transmits the plurality of data signals and the plurality of gate signals to the display panel.

2. The display device according to claim 1, wherein when the display device displays the plurality of output frames with the second refresh frame rate, the plurality of data signals and the plurality of gate signals are generated based on at least one of a frame-based control rule and a horizontal pixel line-based control rule.

3. The display device according to claim 1, wherein the control circuit comprises:

a timing controller, for receiving the plurality of source frames and accordingly generating a plurality of data driving signals, a data timing signal and a gate timing signal;

a source module, electrically connected to the timing controller and the display panel, for receiving the plurality of data driving signals and the data timing signal, and accordingly generating the plurality of data signals, wherein the source module transmits the plurality of data signals to the display panel and transmits a trigger signal to the timing controller; and a gate module, electrically connected to the timing controller and the display panel, for receiving the gate timing signal and accordingly transmitting the plurality of gate signals to the display panel.

4. The display device according to claim 3, wherein the timing controller dynamically adjusts generation of the plurality of data driving signals, the data timing signal and the gate timing signal in response to level of the trigger signal.

5. The display device according to claim 3, wherein the source module comprises:

a data driving circuit, electrically connected to the timing controller, for receiving the plurality of data driving signals and the data timing signal and accordingly generating a plurality of data control signals;

a plurality of source drivers, electrically connected to the data driving circuit and the display panel, for receiving the plurality of data control signals and accordingly transmitting a plurality of analog data voltages to the display panel as the plurality of data signals;

a plurality of temperature detectors, respectively electrically connected to the plurality of source drivers, for detecting temperatures of the plurality of the source drivers and accordingly generating a plurality of detected temperatures; and a comparison circuit, electrically connected to the plurality of temperature detectors and the timing controller, for generating the trigger signal according to the plurality of detected temperatures.

6. The display device according to claim 5, wherein when all the plurality of detected temperatures are less than a temperature threshold, the comparison circuit sets the trigger signal at a first level and the display panel displays the plurality of output frames with the first refresh frame rate; and when any of the plurality of detected temperatures is greater than or equivalent to the temperature threshold, the comparison circuit sets the trigger signal at a second level and the display panel displays the plurality of output frames with the second refresh frame rate.

7. The display device according to claim 6, wherein the temperature threshold is 150 degrees Celsius.

8. A control circuit, electrically connected to a display panel, comprising:

a timing controller, for receiving a plurality of source frames with a source frame rate and accordingly generating a plurality of data driving signals, a data timing signal and a gate timing signal;

a source module, electrically connected to the timing controller and the display panel, for receiving the plurality of data driving signals and the data timing signal and accordingly generating a plurality of data signals, wherein the source module transmits the plurality of data signals to the display panel; and a gate module, electrically connected to the timing controller and the display panel, for receiving the gate timing signal and accordingly transmitting a plurality of gate signals to the display panel, wherein the display panel displays a plurality of output frames with one of a first refresh frame rate and a second refresh frame rate, wherein the source frame rate is equivalent to the first refresh frame rate, and the source frame rate is greater than the second refresh frame rate.

9. The control circuit according to claim 8, wherein when the display device displays the plurality of output frames with the first refresh frame rate, the source module continuously transmits the plurality of data signals to the display panel, and the gate module continuously transmits the plurality of gate signals to the display panel.

10. The control circuit according to claim 9, wherein the source module comprises:

a data driving circuit, electrically connected to the timing controller, for receiving the data driving signals and the data timing signal and accordingly generating a plurality of data control signals;

a plurality of source drivers, electrically connected to the data driving circuit and the display panel, for receiving the plurality of control signals and accordingly transmitting a plurality of analog data voltages to the display panel as the plurality of data signals;

a plurality of temperature detectors, respectively electrically connected to the plurality of source drivers, for detecting temperatures of the plurality of the source drivers and accordingly generates a plurality of detected temperatures; and a comparison circuit, electrically connected to the plurality of temperature detectors and the timing controller, for generating a trigger signal according to the plurality of detected temperatures.

11. The control circuit according to claim 10, wherein the timing controller dynamically adjusts generation of the data driving signals, the data timing signal and the gate timing signal in response to levels of the trigger signal.

12. The control circuit according to claim 10, wherein when all the plurality of detected temperatures are less than a temperature threshold, the comparison circuit sets the trigger signal at a first level and the display panel displays the plurality of output frames with the first refresh frame rate; and when any of the plurality of detected temperatures is greater than or equivalent to the temperature threshold, the comparison circuit sets the trigger signal at a second level and the display panel displays the plurality of output frames with the second refresh frame rate.

13. The control circuit according to claim 8, wherein when the display device displays the plurality of output frames with the second refresh frame rate, the source module selectively transmits the plurality of data signals to the display panel, and the gate module selectively transmits the plurality of gate signals to the display panel, wherein the plurality of data signals and the plurality of gate signals are generated based on at least one of a frame-based control rule and a horizontal pixel line-based control rule.

14. A control method applied to a display device, comprising steps of:

receiving a plurality of source frames with a source frame rate;

generating a plurality of data signals and a plurality of gate signals based on the plurality of source frames; and outputting a plurality of output frames with one of a first refresh frame rate and a second refresh frame rate, wherein the source frame rate is equivalent to the first refresh frame rate, and the source frame rate is greater than the second refresh frame rate, wherein when the plurality of output frames are displayed with the first refresh frame rate, the plurality of data signals and the plurality of gate signals are continuously transmitted; and when the plurality of output frames are displayed with the second refresh frame rate, the plurality of data signals and the plurality of gate signals to the display panel are selectively transmitted.

15. The control method according to claim 14, wherein when the plurality of output frames are displayed with the second refresh frame rate, the plurality of data signals and the plurality of gate signals are generated based on at least one of a frame-based control rule and a horizontal pixel line-based control rule.

16. The control method according to claim 14, wherein the step of generating the plurality of data signals and the plurality of gate signals further comprises steps of:

receiving the plurality of source frames and accordingly generating a plurality of data driving signals, a data timing signal and a gate timing signal;

receiving the plurality of data driving signals and the data timing signal, and accordingly generating the plurality of data signals;

transmitting the plurality of data signals; and receiving the gate timing signal and accordingly transmitting the plurality of gate signals.

17. The control method according to claim 16, further comprises steps of:

detecting temperatures of a plurality of the source drivers and accordingly generating a plurality of detected temperatures generating a trigger signal according to the plurality of detected temperatures; and dynamically adjusting generation of the plurality of data driving signals, the data timing signal and the gate timing signal in response to levels of the trigger signal.

18. The control method according to claim 17, wherein when all the plurality of detected temperatures are less than a temperature threshold, the trigger signal is set at a first level and the plurality of output frames are displayed with the first refresh frame rate; and when any of the plurality of detected temperatures is greater than or equivalent to the temperature threshold, the trigger signal is set at a second level and the plurality of output frames are displayed with the second refresh frame rate.

* * * * *